US005735647A

United States Patent [19]

Woodings et al.

[11] Patent Number: 5,735,647

[45] Date of Patent: Apr. 7, 1998

[54] TAP HOLE DRILL FOR STEELMAKING VESSEL

[75] Inventors: Robert T. Woodings, Pittsburgh; Martin P. Miller, Portersville, both of Pa.

[73] Assignee: Woodings Industrial Corporation, Mars, Pa.

[21] Appl. No.: 599,982

[22] Filed: Feb. 14, 1996

[51] Int. Cl.[6] ..... B23B 39/14

[52] U.S. Cl. ..... 408/103; 408/108; 408/129; 408/236; 173/32

[58] Field of Search ..... 408/103, 108, 408/56, 57, 87, 97, 72, 129, 135, 224, 236; 175/426–431, 355, 352, 341; 29/26 A, 33 K, 33 T; 173/32, 33, 165; 269/87.3

[56] References Cited

U.S. PATENT DOCUMENTS

| | | | |
|---|---|---|---|
| 591,135 | 10/1897 | Kerry | 408/103 |
| 3,961,673 | 6/1976 | Wolters et al. | 173/32 X |
| 4,403,892 | 9/1983 | Kane | 173/32 X |
| 4,475,606 | 10/1984 | Crow | 175/431 |
| 4,896,663 | 1/1990 | Vandewalls | 408/97 X |
| 5,129,464 | 7/1992 | Richier | 173/32 X |
| 5,273,124 | 12/1993 | Lloyd et al. | 173/32 X |
| 5,279,375 | 1/1994 | Tibbitts et al. | 175/428 |

*Primary Examiner*—Daniel W. Howell
*Assistant Examiner*—Henry W. H. Tsai
*Attorney, Agent, or Firm*—James Ray & Associates

[57] ABSTRACT

A drilling apparatus for drilling a worn and/or damaged tap hole refractory liner sleeve from a tap hole nozzle of an oxygen blown steelmaking vessel, the apparatus including an elongated, hollow boom structure with an elongated drill shaft rotatably disposed within the boom structure, motor means for rotating the drill shaft and moving it in both directions within the boom structure, and a clamp means at the outer end of the boom structure adapted to attach the outer end of the boom structure to the tap hole nozzle in an accurate, axially aligned position. A drill bit for use with the above drilling apparatus comprises a plurality of conventional rock drill bits attached to a base plate equally spaced in a pair of concentric circular arrangement around an axis of the base plate.

20 Claims, 7 Drawing Sheets

TAP HOLE DRILL FOR STEELMAKING VESSEL

FIELD OF THE INVENTION

This invention relates generally to a tap hole drill for an oxygen blown steelmaking vessel, and more particularly to a new and unique tap hole drilling apparatus and a drill bit therefor, that can be utilized to quickly, easily, safely and neatly remove an old, worn or damaged tap hole refractory liner sleeve from the tap hole nozzle of an oxygen blown steelmaking vessel, without damaging the adjacent vessel refractory lining wall, thereby leaving a smooth and uniform drilled aperture within which a replacement refractory liner sleeve can quickly and easily be cemented. In addition, the drilling apparatus can be utilized to simplify insertion of the replacement liner sleeve by properly and accurately positioning the replacement liner sleeve within the drilled aperture, where it can be maintained while it is shimmed in place for subsequent cementing with a blown plastic refractory.

BACKGROUND OF THE INVENTION

The manufacture of steel from blast furnace hot metal is most commonly done today in oxygen blown steelmaking processes, whereby high purity oxygen is blown onto or into a shallow bath of hot metal contained within a suitable tilting, steelmaking vessel. The most common of these processes is the basic oxygen process, referred to as the BOP process, or BOF (basic oxygen furnace), wherein the steelmaking vessel comprises a concentric, barrel-shaped steel shell having refractory lining of basic refractories, typically comprising an exposed surface of magnesite bricks. The vessel, having a vertically disposed axis for steelmaking, is tiltable and normally fully rotatable about fixed horizontal trunnions, from its normal upright, vertical position having a small opening or mouth at the top.

To manufacture steel, the BOF vessel is tilted downwardly about 45° in the forward direction and maintained in such a diagonally inclined position to receive the charge, namely blast furnace hot metal, or other sources of molten iron, along with a controlled amount of scrap metal. When suitably charged, the BOF vessel is tilted upwardly, and a retractable, elongated, water cooled lance is lowered through the upwardly disposed mouth of the vessel, and when suitably positioned, high purity oxygen is blown through the lance onto the upper surface of molten metal in the bottom of the vessel at sonic velocities and pressures in the vicinity of 150 psi. The oxygen blast not only serves to agitate and stir the hot metal, but further causes a complex series of oxidation reactions whereby, along with suitable fluxes discharged into the vessel from overhead storage bins, the hot metal impurities (most commonly, carbon, sulfur, phosphorous, silicon and manganese) are oxidized from the metal bath and collected in a controlled slag which floats on the surface of the molten metal bath within the vessel. When the operation is completed, after about 20 minutes, the lance is retracted, and the BOP vessel is tilted, normally in the backward direction, to a position where the molten steel can be tapped into a waiting teeming ladle through a tap hole nozzle in the back side of the BOP vessel. The tap hole nozzle is placed such that the vessel can be tilted to a position where the molten steel can be tapped from under the molten slag floating on the upper surface thereof. After the steel is tapped through the tap hole nozzle, the vessel is tilted, normally in the forward direction, to permit the molten slag to be poured through the vessel mouth into a slag ladle, from which the slag can be discarded. Rotation of the vessel to a fully inverted position will permit solids and debris to fall through the vessel mouth onto the ground or shop floor.

More recently, the Q-BOP process has come into use in the manufacture of steel. This process is essentially the same as the BOP process briefly described above, and differs primarily in that the oxygen is blown into the metal bath from below, through a plurality of sub-surface tuyeres in the floor of the Q-BOP vessel. The tuyeres are double concentric tuyeres, provided with an axial port for admitting the high purity oxygen, and an encircling, annular port through which an enveloping inert gas, such as argon, is injected. The enveloping gas is essential because the subsurface injection of oxygen alone would very quickly oxidize and burn-away the tuyeres in the presence of the molten metal at temperatures in excess of 3,000° F. But for these differences in oxygen injection, the processes as described above are essentially the same, and accordingly, the tap hole drill of this invention is equally applicable for use with regard to either a BOP vessel or a Q-BOP vessel, which are collectively referred to herein as "oxygen blown steelmaking vessels".

The above noted tap hole nozzle through which the finished steel is tapped, is normally positioned in the back side of the vessel equally spaced between the trunnions, with the inside nozzle opening located at a cylindrical, refractory back wall immediately under a conical top portion of the vessel extending upwardly to the mouth at the top, so that when the vessel is suitably tilted, the tap hole nozzle can be placed in a lowermost position as necessary to permit the finished steel to be tapped therethrough from under the slag floating on the surface. Normally, the tap hole nozzle comprises an annular steel sleeve member defining the outer surface extending radially from the back side of the steel vessel shell, with a replaceable, refractory liner sleeve cemented within the steel sleeve member with a layer of hardenable plastic refractory "gunned" or blown into the annular cavity between the refractory liner sleeve and the steel sleeve member to axially cement the refractory liner sleeve in place. Accordingly, the finished steel is tapped through the refractory liner sleeve which extends from the inside surface of the vessel refractory lining to the outer end of the steel sleeve member. As should be expected, the hot, molten steel being tapped through the refractory liner sleeve will naturally cause excessive wear, erosion and damage to the liner sleeve, so that such a refractory liner sleeve must be removed and replaced at relatively frequent time intervals. Typically, such worn and damaged liners are removed manually by virtually cutting and knocking the liner sleeve free from the steel sleeve and vessel refractory liner with an air chisel or similar tool, and knocking out the old gunned refractory with an elongated bar. This manual procedure is not only a time consuming and an unpleasant task, but often leaves a rather rough and uneven surface at the edges of the vessel refractory lining into which the replacement refractory liner sleeve must be cemented. Such rough and uneven surfaces will not only make it more difficult to properly shim the replacement liner sleeve in place for gunning with a plastic refractory, but will often lead to resulting cavities between the liner sleeve and underlying vessel refractory, which can greatly shorten the life of the replaced refractory liner sleeve.

SUMMARY OF THE INVENTION

The present invention is predicated upon the conception and development of a new and unique drilling apparatus and a new, unique and inexpensive drill bit therefor, designed and adapted to quickly, easily and safely drill-out and remove an old, worn or damaged refractory liner sleeve from a tap hole nozzle of an oxygen blown steelmaking vessel, without damaging the vessel refractory lining adjacent thereto, to consistently leave a uniform cylindrical aperture in the vessel refractory liner properly aligned with the tap hole nozzle, within which a replacement refractory liner sleeve can more easily and quickly be cemented. As compared to manual removal techniques, the apparatus of this invention is not only quicker, easier, safer and neater, but will enhance the life of the replacement liner by virtue of the neater aperture into which the replacement liner is cemented. As an added benefit, the drilling apparatus of this invention can optionally include means adapted to axially position and maintain the replacement refractory liner sleeve within the drilled-out aperture, so that it can be accurately and quickly positioned and shimmed, for subsequently receiving the gunned plastic refractory therearound to more quickly and accurately cement the liner sleeve in place.

In essence and in it simplest form, the drilling apparatus of this invention is an adjustable apparatus including a drill for drilling-out an old refractory liner sleeve from the tap hole nozzle of an oxygen blown steelmaking vessel, and comprises a base structure having a means to securely position the tap hole drilling apparatus with respect to the steelmaking vessel so that the drilling apparatus will be properly positioned and aligned with the vessel tap hole nozzle; an elongated, hollow boom structure adjustably extending from the base structure; an elongated drill shaft rotatably disposed within the boom structure having an outer working end adapted to extend beyond an outer end of the boom structure and adapted to receive a drill bit; a first motor means for rotating the drill shaft within the boom structure; a second motor means for selectively moving the drill shaft axially in both directions within the boom structure; and a clamp means disposed on the outer end of the boom structure adapted to engage the outer end of the tap hole nozzle on the steelmaking vessel to axially align the boom structure and drill shaft with the tap hole nozzle to thereby permit a controlled, accurate drilling-out of the old tap hole liner sleeve.

A preferred embodiment of the inventive drilling apparatus will further include adjustment means adapted to adjust the position and angle of the boom structure such that the outer end thereof can be generally axially aligned with the tap hole nozzle prior to clamping, and a power cylinder means for activating the clamp means to forcibly attach the boom structure to the tap hole nozzle in an accurate, axially aligned position. In combination with such a power cylinder, the adjustment means to generally axially align the boom structure with the tap hole nozzle should be sufficiently relaxible providing some degree of "give" to prevent interference with the power cylinder's effort to forcibly attach the end of the boom structure to the nozzle in an accurate, axially aligned position. In addition, a preferred embodiment may further include a drill shaft which is further adapted to receive a spindle to hold a replacement tap hole liner sleeve axially aligned with the drive shaft and, therefore, insertable into the aperture drilled through the tap hole nozzle to assist in the proper shimming of the replacement liner sleeve. In addition, further preferred embodiments may also include means for blowing air through the drill shaft to blow drilling debris from the drilled aperture, including a variety of other features that would assist in the alignment of the boom structure to the tap hole nozzle and the drilling-out of the old liner sleeve, such as substituting a rotary percussion drill for the rotary motor means for rotating the drill shaft.

In essence and in its simplest form, the unique drill bit of this invention comprises a circular base plate upon which a plurality of conventionally sized drill bits are attached in two concentric circular arrangements, whereby the orbital motion of the outer circular arrangement is intended to advance into the tap hole nozzle to firstly commence cutting into the blown refractory encircling the liner sleeve to define the outer perimeter of the drilled aperture, and the orbital motion of the inner circular arrangement is intended to follow, thereby removing the old liner sleeve.

OBJECTS OF THE INVENTION

It is, therefore, the primary object of the present invention to provide a new and unique drilling apparatus to greatly simplify the removal and replacement an old, worn or damaged tap hole refractory liner sleeve within the tap hole nozzle of an oxygen blown steelmaking vessel which will eliminate the need for unpleasant and time-consuming manual removal.

Another object of this invention is to provide a new and unique drilling apparatus that can be utilized to quickly, easily, safely and more neatly drill-out an old, worn or damaged tap hole refractory liner sleeve from the tap hole nozzle of an oxygen blown steelmaking vessel.

A further object of this invention is to provide an apparatus for removing an old, worn or damaged tap hole refractory liner sleeve from the tap hole nozzle of an oxygen blown steelmaking vessel without damaging the adjacent vessel refractory lining wall, thereby leaving a smooth and uniform cylindrical aperture within which a replacement refractory liner sleeve can quickly and easily be cemented.

Still another object of this invention is to provide a drilling apparatus that can be utilized to remove an old, worn or damaged tap hole refractory liner sleeve from the tap hole nozzle of an oxygen blown steelmaking vessel which can further be utilized to properly position a replacement liner sleeve within the drilled aperture for subsequent cementing in place.

An even further object of this invention is to provide a new, unique and inexpensive compound drill bit that can be utilized with the drilling apparatus of this invention for drilling an old, worn or damaged tap hole refractory liner sleeve within the tap hole nozzle of an oxygen blown steelmaking vessel.

These and other objects and advantages of this invention will be realized from a full understanding of the following detailed description particularly when read in conjunction with the attached drawings, as described below.

DESCRIPTION OF A PREFERRED EMBODIMENT OF THE INVENTION

Figure 1:
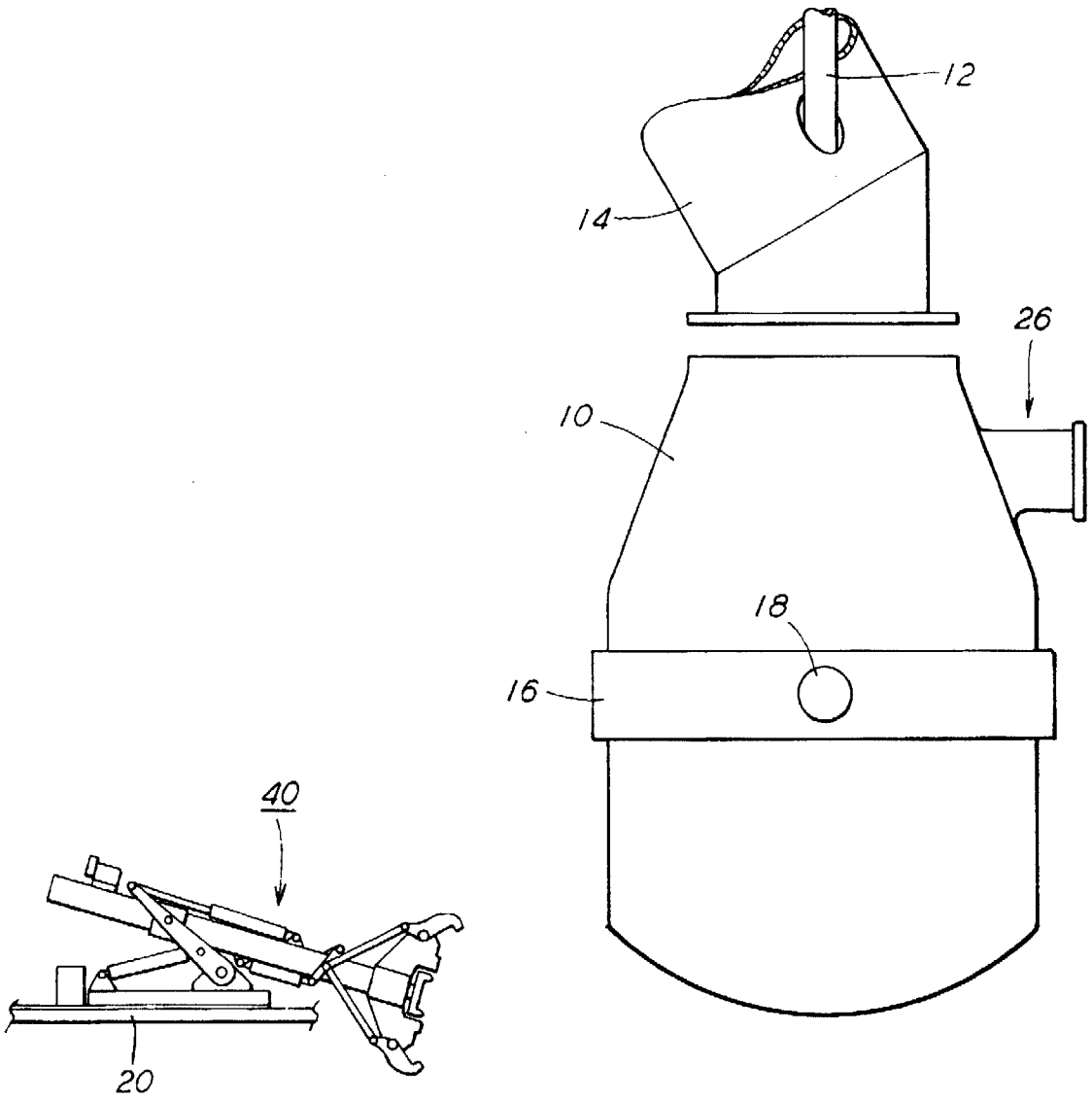
FIG. 1 is an elevational side view of a BOP vessel in a typical BOP shop, showing the relationship of the inventive drilling apparatus of this invention to the BOP vessel, with the vessel positioned with its axis vertically oriented in the normal steelmaking position.

Prior to proceeding with a more detailed description of the drilling apparatus of this invention, it should be noted that throughout the several views illustrated in the attached drawings, identical components which have associated therewith identical functions have been identified with identical reference numerals for the sake of clarity.

Figure 2:
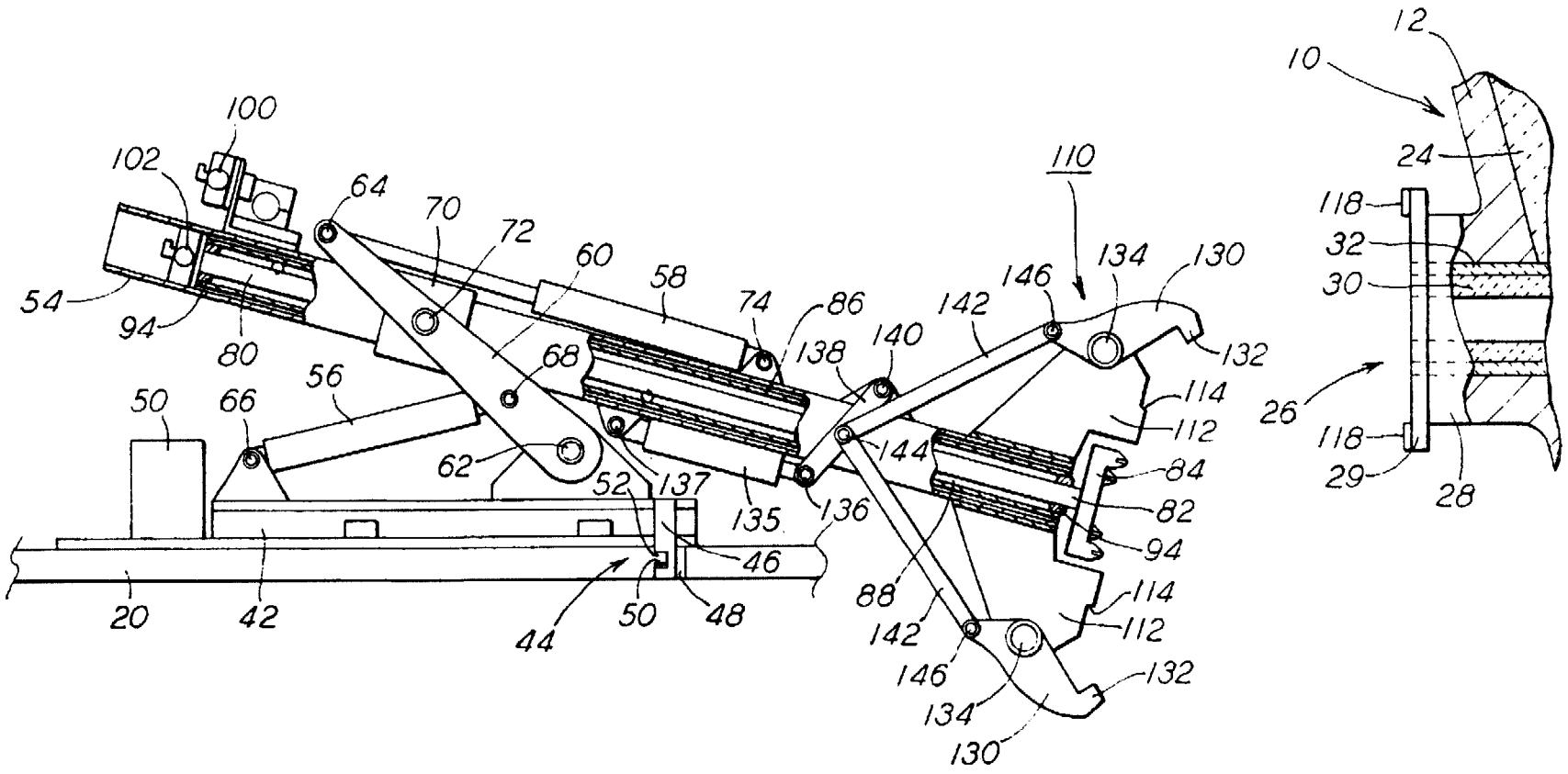
FIG. 2 is a cross-sectional, elevational side view similar to that of FIG. 1, but in a larger scale so that the drilling apparatus can be better described and understood. As shown, the tap hole nozzle is visible on the BOP vessel, which has been tilted downwardly to properly position the tap hole nozzle as necessary for utilizing the inventive drilling apparatus to drill-out an old refractory liner sleeve.

Referring now to the drawings, FIG. 1 illustrates a section through a typical BOP shop, where the BOP vessel 10, is shown in a vertically disposed position as utilized for steelmaking, with the oxygen lance 12 having been lowered through the vessel hood 14 and vessel mouth thereunder. As shown, the BOP vessel 10 is usually supported within a trunnion ring 16, and is tiltable about diametrically opposed trunnions 18 rigidly attached to the trunnion ring 16. The drilling apparatus 40 of this invention is shown as properly positioned at the back side of vessel 10, on charging floor 20. In FIGS. 1 and 2, the drilling apparatus 40 is shown in an "at rest" position as it might appear when not being utilized. But for the inclusion of the drilling apparatus 40, such a BOP shop arrangement is well known in the art and need not be further described here.

Figure 3:
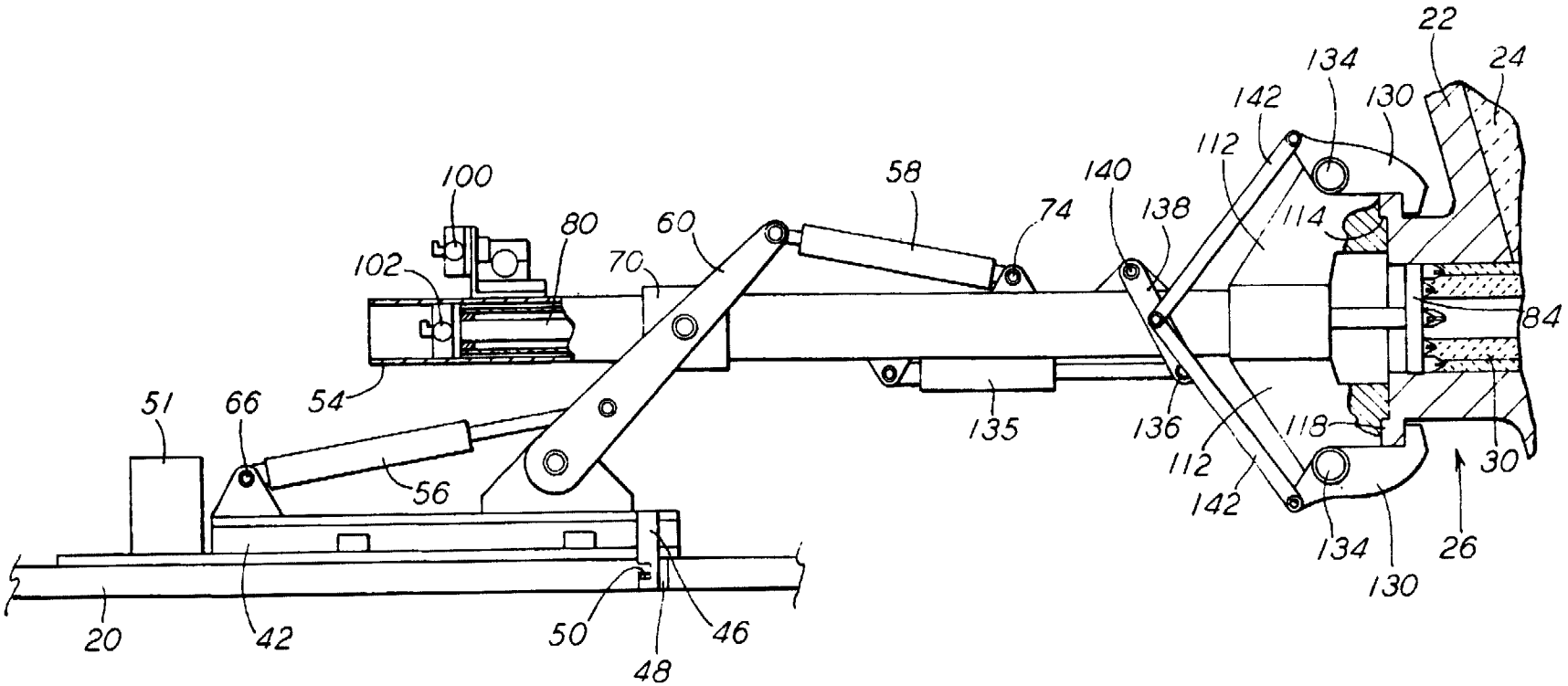
FIG. 3 is a cross-sectional, elevational side view substantially the same as FIG. 2 but showing the drilling apparatus clamped to the BOP vessel tap hole nozzle and the drilling apparatus as it would appear while drilling-out an old tap hole refractory liner sleeve.
Figure 4:
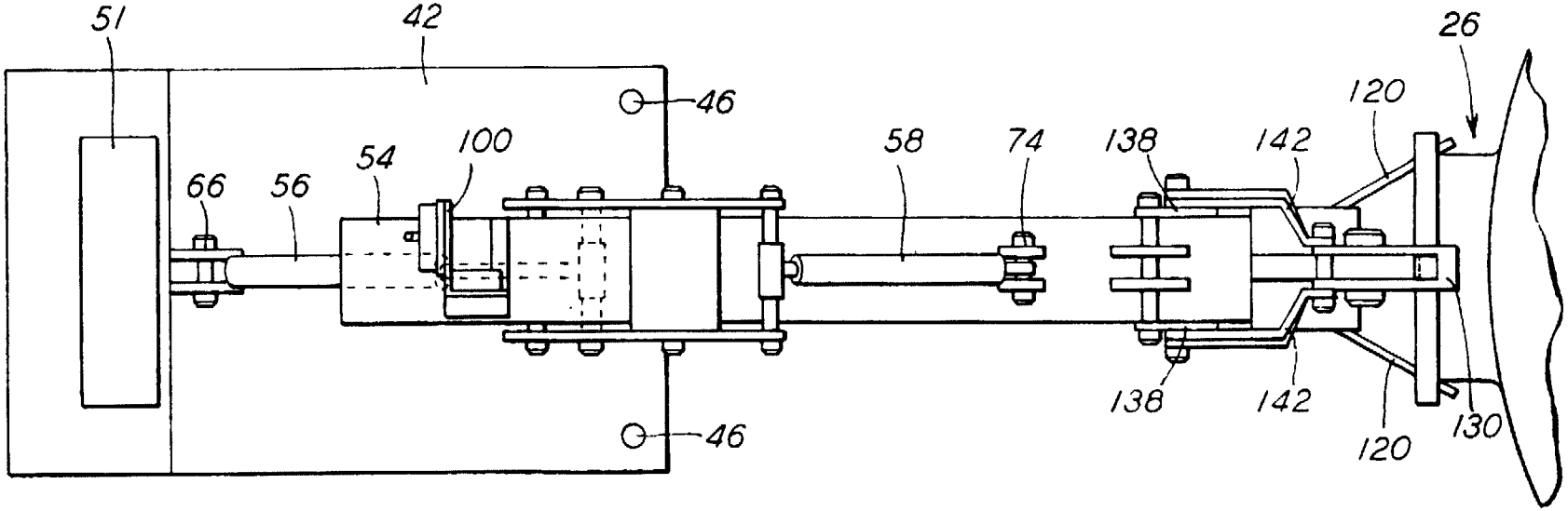
FIG. 4 is a cross-sectional top view of the apparatus shown in FIG. 3.

Reference to FIGS. 2–4 partially illustrates a typical BOP vessel 10 wherein the barrel-shaped steel shell 22 is lined with a basic refractory 24, which is usually formed of stacked refractory bricks. The tap hole nozzle 26 is provided on the back side of the vessel 10, and normally comprises an annular steel shell 28, having a flange 29, within which a replaceable, refractory liner sleeve 30 is axially cemented with a blown plastic refractory 32. Obviously, the liner sleeve 30 not only extends through the length of the annular steel shell 28, but must also extend through the thickness of the vessel refractory 24.

Reference to FIG. 2 will best illustrate the drilling apparatus 40 of this invention, which essentially comprises a base structure 42 and means 44 to securely position the base structure 42 at a preselected position on the charging floor 20 relative to the BOP vessel 10. While a great number of differing means could be utilized to securely fasten the drilling apparatus 40 to the charging floor 20, a presently preferred means, as shown in the drawings, comprises a pair of pins 46 extending from the undersurface of base structure 42 which are insertable into a pair of properly positioned apertures 48 in the charging floor 20 which are properly spaced and adapted to receive pins 46. As further shown, pins 46 each have a notch 50 on the back side which are adapted to engage flanges 52 in the back side of apertures 48. Accordingly, to suitably secure base structure 42 onto charging floor 20, pins 46 are lowered into apertures 48, and the base structure 42 is pushed backwards so that notches 50 on pins 46 will engage flanges 52 within apertures 48. Normally, such a pushing effort will not be necessary as an individual step, as the attaching and drilling activities, described below, will cause the base structure 42 to be moved backwards and suitably lock notches 50 onto flanges 52.

An elongated, hollow and rectangular boom structure 54 is adjustably attached to, and extends from the base structure 42 in the direction of BOF vessel 10. The adjustability of the attachment is effected by hydraulic cylinders 56 and 58 which are suitably interlinked to boom structure 54, for the purpose of adjusting the height and angle of boom structure 54 relative to charging floor 20. Intermediate linkage between base structure 42 and hydraulic cylinders 56 and 58, comprises a pair of parallel lever arms 60, having fixed ends pivotally attached to base structure 42 at pins 62, with the outer, pivotal ends joined by pin 64 extending transversely therebetween. Hydraulic cylinder 56 is disposed directly under boom structure 54 and is centrally positioned between parallel lever arms 60, having its fixed end rotatably pinned to base structure 42 at pin 66, with its outer, reciprocal end pivotally connected to pin 68, which extends between lever arms 60 under boom structure 54. A rectangular collar 70, rigidly secured around boom structure 54, has a pair of pivot pins 72 extending horizontally, and diametrically therefrom, which are rotatably pinned between lever arms 60. On the other hand, hydraulic cylinder 58, also centrally disposed between lever arms 60, has its fixed end rotatably attached to the upper surface of boom structure 54 at pin 74, and its outer, reciprocating end pivotally connected to pin 64 which extends between the outer ends of lever arms 60. As should be apparent from the drawings, the outward adjustment of hydraulic cylinder 56, will cause lever arms 60 to be rotated in a clock-wise direction (as illustrated) thereby lifting boom structure 54 at pins 72, and at the same time, advancing the outer end of boom structure 54 in the direction of the vessel 10. Activation of hydraulic cylinder 58, on the other hand, will serve to raise or lower the outer end of boom structure 54, thereby leveling it as necessary to generally mate with the tap hole nozzle 26 of vessel 10. A careful examination of FIGS. 2 and 3 will readily reveal the nature of such adjustments, so that further discussion thereof here is not deemed necessary.

Figure 5:
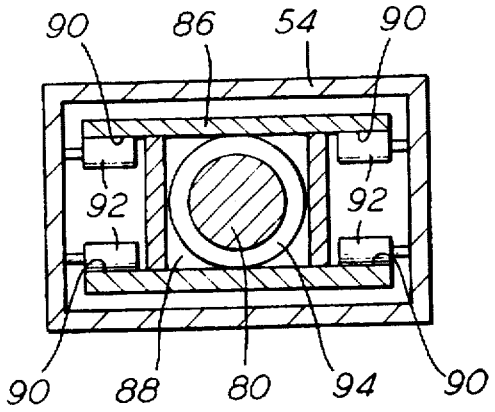
FIG. 5 is a cross-sectional end view of the boom structure, showing the relationship of the drill shaft and drive member therein.

An elongated drill shaft 80 is rotatably disposed within boom structure 54, having an outer working end 82 adapted to extend beyond the outer end of boom structure 54 and further adapted to receive a drill bit 84. While the interconnecting arrangement and form of boom structure 54 is not critical, boom structure 54 as illustrated, is rectangular or square in section, having a generally rectangular drive member 86 slidably disposed therein. As can better be seen in the cross-sectional drawing of FIG. 5, drive member 86 is preferably a composite structure, made of steel channels and/or plates to provide a rectangular form having an elongated opening 88 throughout its length, and a pair of elongated, laterally extending flanges 90 throughout it length, one forming a top surface and one forming a bottom surface. The reciprocal sliding action of drive member 86 is achieved by providing a plurality of opposed, horizontally disposed rollers 92 attached to each inside, side surface of boom structure 54, with a first portion of rollers 92 aligned on a lower plane, and adapted to engage the upper surfaces of lower flange 90 of drive member 86, and a second portion of rollers 92 aligned on an upper plane, adapted to engage the lower surfaces of the upper flange 90 of drive member 86. Accordingly, drive member 86 is adapted for reciprocal motion within boom structure 54, with flanges 90 engaging rollably against rollers 92. Elongated drill shaft 80, on the other hand, is rotatably disposed within drive member 86, and supported at each end by bearings 94 at the extremities of drive member 86. A chain drive 96 is also disposed within the opening 88 of drive member 86.

With reference again to FIGS. 2–4, a motor drive means 100 is attached to the upper surface of boom structure 54 for the purpose of axially advancing and retracting drive member 86 within boom structure 54, via suitable linkage to chain drive 96. Several such suitable chain drive systems are well known in the art, particularly the art pertaining to blast furnace tap hole drills, and therefore, need not be described here. An example of such a chain drive system can be found in U.S. Pat. No. 5,069,430, titled "Blast Furnace Tap Hole Drill Having Centralizing Drill Rod Support", dated Dec. 3, 1991, and assigned to the assignee of this invention, which is incorporated herein by reference. Obviously, rack and pinion systems could be designed which would work equally well.

Another motor means 102 is attached to the back end of drive member 86 for the purpose of rotating the drill shaft 80 as necessary to drill-out the old tap hole liner sleeve 30. While motor means 102 could be a pneumatic percussion drill as utilized in blast furnace tap hole drills, it has been found that the refractory materials drilled from steelmaking vessel tap hole nozzles pursuant to this invention, are not normally hard enough to demand a percussion drill, and therefore a simple rotary motor, whether hydraulic or pneumatic, is normally adequate for motor means 102, to drill-out an old tap hole liner sleeve 30 and the old, hardened, blown refractory therearound.

A clamping means 110 is disposed on the outer end of boom structure 54 for the purpose of clamping the outer end of boom structure 54 in a properly, axially aligned position onto the outer end of tap hole nozzle 26 extending from BOF vessel 10. As shown, clamping means 110 comprises a pair of diametrically opposed wing flanges 112 rigidly secured at the extreme outer end of boom structure 54, each having a forward edge adapted to engage the outer annular surface of tap hole nozzle 26 in such a manner that boom structure 54, and particularly drill shaft 80, will be axially aligned with tap hole nozzle 26. As shown, in the drawings, the outer-forward ends of wing flanges 112 protrude forward of the outer end of boom structure 54, sufficiently to permit such forward edges of such forward ends to extend around drill bit 84 to make contact with the outer surface of tap hole nozzle 26. The extreme forward edge of each wing flange 112 must be provided with means to permit proper axial alignment of boom structure 54, and accordingly drill shaft 80, with tap hole nozzle 26. While any one of a number of different arrangements could be provided, one preferred arrangement as shown is to provide each forward edge of wing flanges 112 with a shallow notch 114 at the inside edge thereof, as shown, adapted to engage the inside edge of an outer face ring flange 118 at the extreme outer circular face of tap hole nozzle 26. By positioning notches 114 diametrically within ring flange 118, boom structure 54 will be axially centered on ring flange 118, and accordingly, axially centered on tap hole nozzle 26. It should be quite obvious that a number of other or additional such alignment means could be utilized, particularly as may be necessary to assure alignment perpendicularly to wing flanges 112. As for example, as shown in the top view of FIG. 4, a pair of lateral guides 120, adapted to engage prepositioned grooves (not shown) in the flange 26 on tap hole nozzle 26, can also be provided, or in a more expensive alternative, four wing flanges 112 could be provided, arranged in a cruciform configuration. Clearly, therefore, it should be readily apparent that a great number of alternate systems could be designed to assure proper alignment and engagement of the end of boom structure 54 with the outer face of tap hole nozzle 26.

A pivotal lock arm 130 having a locking notch 132 at its end, is pivotally attached at the outer end of each wing flange 112 at pins 134, which are designed so that locking arms 130 can be pivoted at pivot pin 134 as necessary to position locking notches 132 behind circular flange 29 on tap hole nozzle 26, thereby locking the forward edges of wing flanges 112 against the outer annular surface of tap hole nozzle 26. If the dimensional tolerances are closely controlled, the locking of locking notches 132 onto flange 29 will not be achievable unless wing flanges 112 are properly aligned against tap hole nozzle 26.

Pivotal lock arms 130 are activated by a hydraulic cylinder 135, which has its fixed end attached to the underside of boom structure 54 at pin 137, and its reciprocal free end pivotally attached to pin 136, which connects the lower ends of a pair of parallel, pivotal levers 138 on each side of boom structure 54. The upper ends of pivotal levers 138 are pivotally pinned to a fixed pin 140 horizontally positioned over the upper surface of the boom structure 54, with the spread ends of lever yokes 142 rotatably pinned to pivotal levers 138 at pins 144, midway between pins 136 and 140. Accordingly, hydraulic cylinder 135 is designed to reciprocally pivot the lower ends of the pair of pivotal levers 138, thereby advancing outwardly and retracting pins 144. The centered, opposite end of each lever yoke 142 is pivotally pinned at pin 146 to each of the pivotal lock arms 130. As should be apparent from an examination of the drawings, activation of hydraulic cylinder 135 causing its free end at pins 136 to move outwardly, will rotate parallel pivotal levers 138 counter-clockwise (as shown) causing the pins 144 at its midlength to be pushed outwardly toward the vessel 10, and accordingly, cause lever yokes 142 to be advanced diagonally outwardly, pivoting pivotal lock arms 130 as necessary to cause them to lock onto the tap hole nozzle flange 29, as shown in FIG. 3. A hydraulic power supply 51 is shown mounted adjacent to base structure 42, which serves to power hydraulic cylinders 56, 58 and 135.

As should be apparent to those skilled in the art, the furnace operator may have difficulty, when rotating vessel 10, to stop the rotation at an exact point where it is precisely aligned with drilling apparatus 40 for the purpose drilling an old liner sleeve. Therefore, vessel 10 should be rotated so that boom structure 54 can be just generally aligned with tap hole nozzle 26 without any degree of precision. If the control valves (not shown) on hydraulic cylinders 56 and 58 are left open, the locking force created by hydraulic cylinder 135 should be sufficient to permit movement of boom structure 54 to assure that the desired alignment is nevertheless achieved.

To utilize the drilling apparatus 40 of this invention, this will most commonly be done after a heat of steel has been produced and tapped, as described above. To replace the tap hole liner sleeve 30, the vessel operator will have to tilt the vessel 10 in a rearward direction until the tap hole nozzle 26 is generally aligned with the drilling apparatus 40, as noted above. Activation of hydraulic cylinder 56, will cause boom structure 54 to be advanced towards the vessel 10, while activation of hydraulic cylinder 58 will be necessary to level and generally align boom structure 54 with the end of tap hole nozzle 26. Then the alignment means at the forward ends of wing flanges 112 is adjusted to position the notches 114 properly engaged with face ring flange 118. When properly engaged, cylinder 135 is activated to pivot lock arms 130 as necessary to lock notches 132 behind flange 29. At the same time, the control valves (not shown) on hydraulic cylinders 56 and 58 are opened which will thereby permit any necessary pivotal adjustment of boom structure 54 when lock arms 130 lock the end of boom structure 54 onto tap hole nozzle 26. Accordingly, boom structure 54 will be locked onto the end of tap hole nozzle 26 in an accurate, axially aligned position. Thereafter, with drill bit 84 attached to drill shaft 80, both motor means 100 and 102 are activated as necessary to rotate drill shaft 80 and the drill bit 84 thereon, as well as progressively advance drive member 86 into the tap hole nozzle 26, allowing drill bit 84 to drill-out the old tap hole liner sleeve 30 and adjacent blown refractory, leaving an aperture therethrough which is axially centered within the tap hole nozzle 26. Since the mouth of the vessel 10 will be oriented downwardly, the drilling debris will be pushed into the vessel 10 by the drilling action and fall to the shop floor through the downwardly oriented mouth of the vessel 10. When the drilling is complete, leaving a smooth and uniform aperture through the tap hole nozzle 26 and furnace refractory adjacent thereto, the drive member 86 can be withdrawn from the tap hole nozzle 26 and the end of boom structure 54 unclamped from the end thereof, which completes the total drilling operation.

Figure 6:
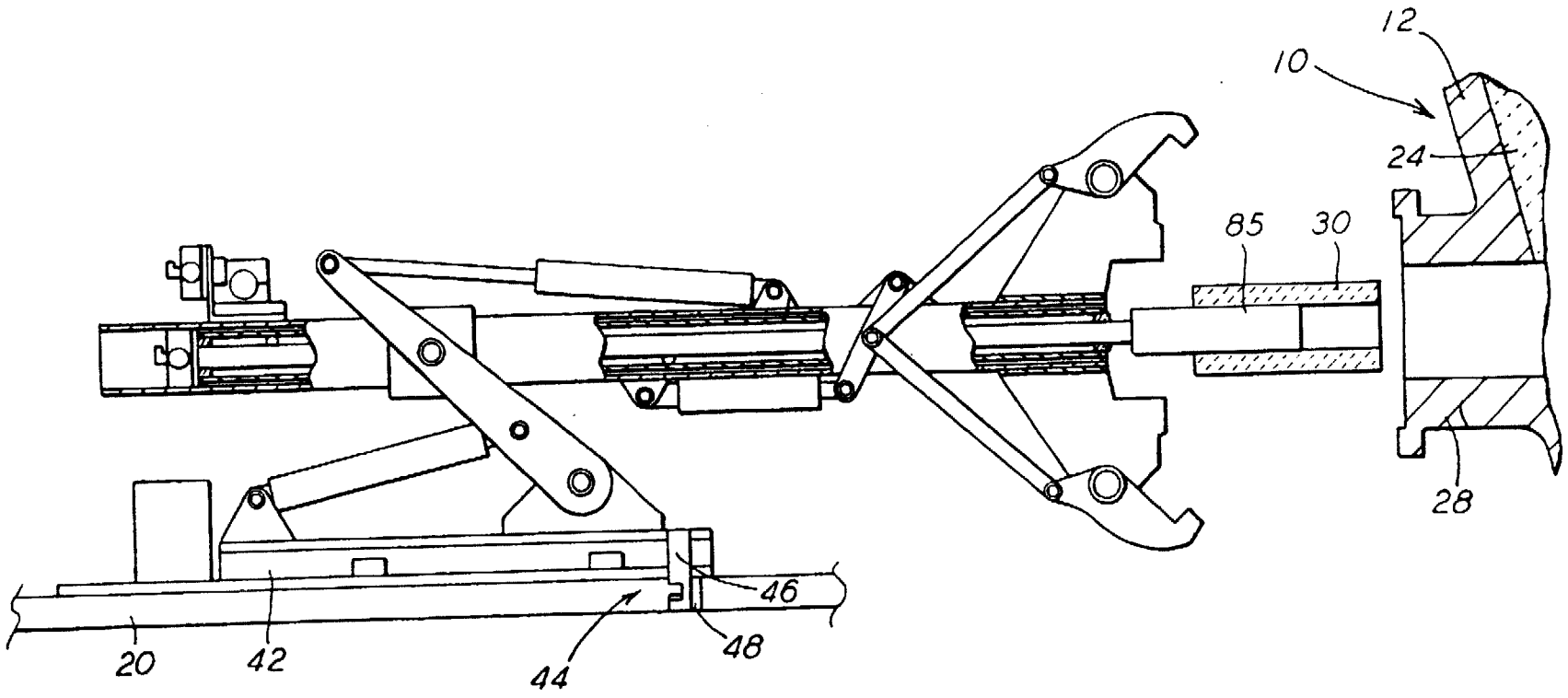
FIG. 6 is a cross-sectional, elevation side view substantially the same as FIG. 3 but showing the drilling apparatus as utilized in the process of inserting a replacement tap hole refractory liner sleeve into the drilled aperture in the tap hole nozzle.

Reference to FIG. 6 will illustrate how the drilling apparatus 40 of this invention can be utilized to assist in the placing of a new tap hole liner sleeve 30 into the aperture drilled to remove an old liner sleeve. For this application, drill bit 84 has to be removed from the end of drill shaft 80, and replaced with a spindle 85. Obviously, the work area immediately adjacent to the tap hole nozzle 26 will be exceedingly hot, so that it is essential that at least the working end of boom structure 54 be moved to a location away from the heat of the tap hole nozzle 26 for purposed of replacing drill bit 84 with spindle 85. The Spindle 85 is merely a cylindrical shaft onto which the new tap hole liner sleeve 30 can be snugly positioned. Thereafter, the apparatus is operated substantially as described above, with or without activation of rotary motor drive 102, with motor drive 100 utilized to advance the new liner sleeve 30 into the aperture drilled from the tap hole nozzle 26. When properly positioned, it is shimmed in place, and drive means 86 withdrawn, such as to withdraw drill shaft 80 and spindle 85, leaving the new liner sleeve 30 in its shimmed position. Thereafter, with boom structure 54 is moved out of the way, a plastic refractory can be gunned into the annular space between the drilled aperture and the new liner sleeve, and the vessel 10 returned to service. Since the vessel 10 will not normally be utilized, or even revolved on the trunnions 18, between drilling operation and the liner sleeve replacement operation, the replacement liner sleeve 30 will most likely be very accurately positioned within the drill aperture for shimming.

Figure 7:
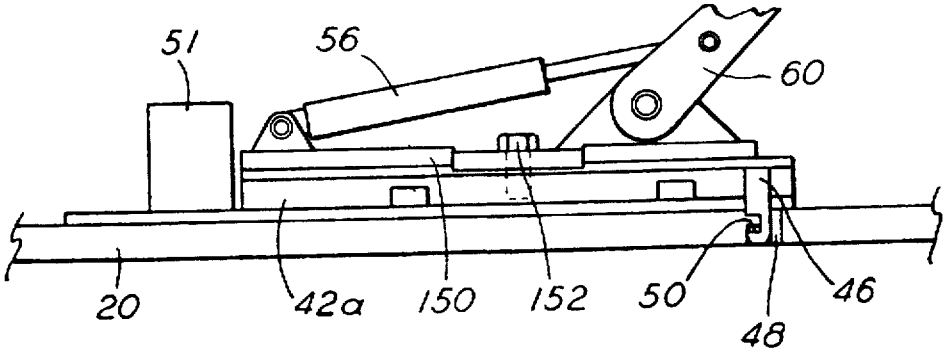
FIG. 7 is an elevational side view of a modified base structure including a means to permit the drilling apparatus mounted thereon to be pivoted laterally for purposes of replacing the drill bit with a spindle.

In addition to the above considerations, it is also preferable that means be included to permit moving the boom structure 54 away from the heat of the tap hole nozzle 26 for purposes of replacing drill bit 84 with spindle 85. One such preferred embodiment for permitting such movement is to provide base structure **42*a* as shown in FIG. 7 having a plate 150 comprising the upper surface which is pivotal about a vertical axis at pin 152. Hydraulic cylinder 56 and lever arms 60 are therefore, pivotally attached to the upper surface of plate 150. Accordingly, plate 150, with boom structure 54 attached thereto, can readily be pivoted laterally on pin 152 to move the working end of boom structure 54 away from the heat of tap hole nozzle 26 for purposes of replacing drill bit 84 with spindle 85. By including detentes or guide marks, plate 150 and boom structure 54 can be pivoted back to its exact starting position where it was when the aperture was drilled through tap hole nozzle 26**, thereby assuring that the replacement liner sleeve will be axially aligned within the aperture previously drilled.

Figure 9:
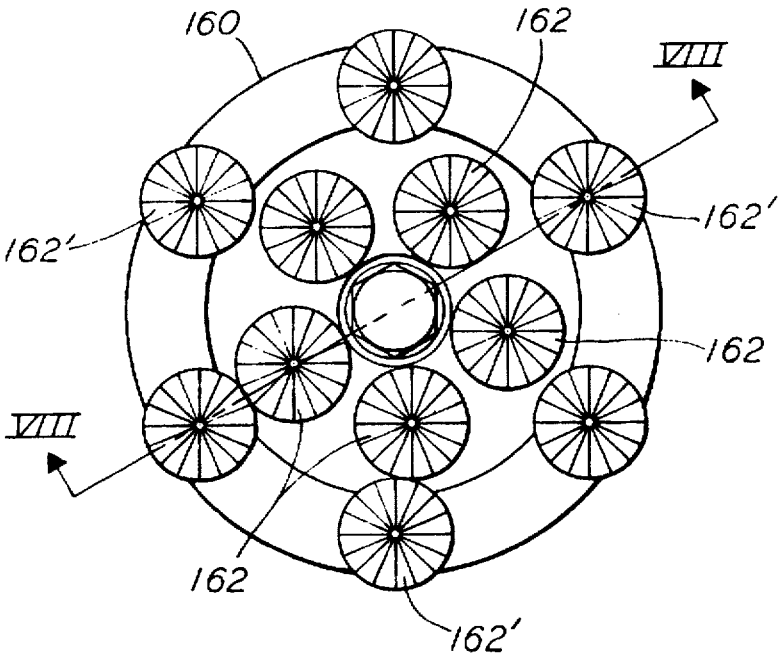
FIG. 9 is an axial end view of the drill bit illustrated in FIG. 8.
Figure 8:
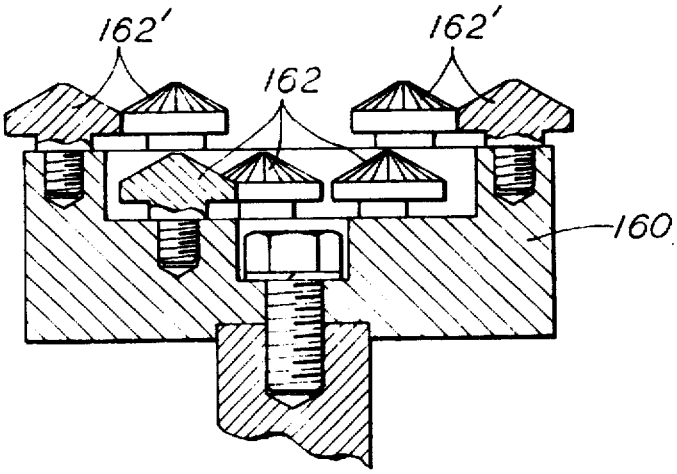
FIG. 8 is a cross-sectional side view of one presently preferred embodiment of the inventive drill bit as may be utilized with the drilling apparatus of this invention, with the section taken at line VIII—VIII on FIG. 9.

In view of the fact that the tap hole refractory liner sleeve to be drilled from the tap hole nozzle 26 is normally about 13 inches in diameter, requiring a drilled aperture of at least about 14–16 inches, it is obvious that a conventional, one piece drill bit fabricated with such a diameter would be rather costly and difficult to work with. Accordingly, a special, low cost drill bit has been developed as shown in FIGS. 8 and 9, for use with the drilling apparatus 40 of this invention, which comprises a circular base plate 160, the back side of which is axially attachable to drill shaft 80, and a front side to which a plurality of conventionally sized drill bits 162 are attached. Specifically, a first plurality of identical, conventional rock drill bits 162, are secured to the forward side of the circular base plate 160 such that the axes of those rock drill bits are generally parallel to the axis of the circular base plate 160 and are equally spaced in a first circular arrangement circumscribing the axis of the base plate. A second plurality of identical, conventional rock drill bits 162' are similarly secured to the forward side of the base plate such that the axes of this second plurality rock drill bits 162' are also generally parallel to the axis of the base plate 160, and are equally spaced in a second circular arrangement circumscribing the first plurality of drill bits 162. Preferably, the second circular arrangement is in a vertical plane somewhat forward of the first circular arrangement, as is shown in FIG. 8. Accordingly, the plurality of drill bits 162 and 162' in each circular arrangement are not intended to rotate on their own individual axes, but rather to move in an orbital manner within their respective circular arrangement around the axis of base plate 160. With this arrangement, the drill bits 162' in the outer circular arrangement will be the first to start cutting into the refractory within the tap hole nozzle 26, which primarily removes the old blown refractory 32 to define the diameter of the drilled aperture. The drill bits 160 in the inner circular arrangement will then serve to knock-out the remaining core, which mostly comprises the old tap hole liner sleeve.

To avoid a resonance which may naturally result, it has been found that the number of drill bits at the inner circular arrangement should preferably be odd in number, and that the drill bits in the outer circular arrangement should be one more in number than those in the inner circle, so that each drill bit is disposed midway between a pair of drill bits in the adjacent circle, substantially as shown in FIG. 9. Ideally, it has been found that to cut an aperture having a 17 inch diameter, five drill bits each having a diameter of 3.5 inches be equally spaced on an inner circle having a diameter of 9.5 inches, with six equally sized drill bits disposed in an outer circular arrangement having a diameter of 17 inches, again substantially as shown in FIG. 9. As another successful embodiment, the drill bits 162' in the outer circular arrangement have been positioned onto base plate 160 such that their individual axes are angled outwardly from the axis of the base plate 160, which naturally results in a drilled aperture of somewhat larger diameter.

While one embodiment of each of the two inventive aspects of this invention have been described above, it should be apparent that any one of the aspects, or combinations of the various aspects, could be utilized without departing from the spirit of the invention. For example, the drilling apparatus 40 could be utilized with any kind of a drill bit, and the drill bit 84 could be utilized with any kind of drilling apparatus. With regard to the drilling apparatus, it should be apparent that any of a large number of modifications could be made to achieve the same result without departing from the spirit of the inventive drilling apparatus as claimed. For example, the hydraulic cylinders and linkage described above to adjust the general position and angle of the boom structure could take any one of a number of different forms, and the cylinders themselves could be either hydraulic or pneumatic, or the linkage in fact motor operated. In addition, the means to flexibly position the base structure relative to such steelmaking vessel could be effected in a number of differing forms. In addition, further preferred embodiments of the drilling apparatus may also include means for blowing air through the drill shaft to blow drilling debris from the drilled aperture, and while the motor means for rotating the drill shaft is shown to be a simple rotary motor, a combination rotary-percussion drill motor could be utilized, particularly if the old refractory to be drilled-out is shown to be harder than average in particular facilities. Obviously therefore, a large number of differing embodiments and modifications could be utilized without departing from the spirit of the invention or the scope of the appended claims.

We claim:

1. A drilling apparatus for drilling a worn or damaged tap hole refractory liner sleeve from a tap hole nozzle of an oxygen blown steelmaking vessel, said drilling apparatus comprising:

(a) an elongated, hollow boom structure;

(b) an elongated drill shaft rotatably disposed within said boom structure, an outer working end of said drill shaft adapted to extend beyond an outer end of said boom structure and further adapted to receive a drill bit;

(c) a first motor means for rotating said drill shaft within said boom structure;

(d) a second motor means for selectively moving said drill shaft axially in both directions within said boom structure; and (e) a clamp means disposed on said outer end of said boom structure adapted to engage an outer end of such tap hole nozzle on such steelmaking vessel and axially align said boom structure and said drill shaft with such tap hole nozzle.

2. A drilling apparatus, according to claim 1, further including mounting means for mounting said drilling apparatus adjacent to such steelmaking vessel.

3. A drilling apparatus, according to claim 2, in which said mounting means comprises a base structure securable in a position adjacent to such steelmaking vessel.

4. A drilling apparatus, according to claim 2, in which said mounting means further including an adjustment means adapted to adjust the position of said boom structure such that said outer working end of said drill shaft can be generally axially aligned with such tap hole nozzle.

5. A drilling apparatus, according to claim 1, further including a power cylinder means for activating said clamp means to forcibly attach said boom structure to such nozzle in an axially aligned position.

6. A drilling apparatus, according to claim 1, in which said clamp means further includes guide means adapted to assure proper axial alignment of said boom structure and said drill shaft with such tap hole nozzle.

7. A drilling apparatus, according to claim 6, in which said guide means comprises at least one flange member having a surface adapted to mate with an outer surface of such tap hole nozzle.

8. A drilling apparatus, according to claim 1, in which said outer working end of said drill shaft is further adapted to receive a spindle upon which a replacement tap hole refractory liner sleeve can be mounted.

9. A drilling apparatus, according to claim 1, in which said first motor means comprises a percussion drill capable of imparting both a rotary and an impact force on said drill shaft.

10. A drilling apparatus, according to claim 1, in which said elongated drill shaft has an axial aperture extending the length thereof, and said drilling apparatus further includes means for blowing air through said aperture.

11. A drilling apparatus, according to claim 1, in which said elongated drill shaft is rotatably disposed within an elongated drive member, said elongated drive member being disposed within said elongated boom structure, and said second motor means for selectively moving said drill shaft functions to selectively move said elongated drive member axially in both directions within said boom structure.

12. A drilling apparatus for drilling a worn or damaged tap hole refractory liner sleeve from a tap hole nozzle of an oxygen blown steelmaking vessel, said drilling apparatus comprising:

(a) a base structure;

(b) means to securely position said base structure relative to such steelmaking vessel;

(c) an elongated, hollow boom structure extending from said base structure;

(d) an adjustment means adapted to adjust a position of said boom structure such that on outer end thereof can be positioned adjacent to and generally axially aligned with such tap hole nozzle on such steelmaking vessel;

(e) an elongated drill shaft rotatably disposed within said boom structure, an outer working end of said drill shaft adapted to extend beyond an outer end of said boom structure and further adapted to selectively receive at least one of a drill bit and a spindle to which a replacement refractory liner sleeve can be mounted;

(f) a first motor means for rotating said drill shaft within said boom structure;

(g) a second motor means for selectively moving said drill shaft axially in both directions within said boom structure; and (h) a clamp means disposed on said outer end of said boom structure adapted to engage an outer end of such tap hole nozzle on such steelmaking vessel and axially align said boom structure and said drill shaft with such tap hole nozzle.

13. A drilling apparatus, according to claim 12, further including a power drive means for activating said clamp means to forcibly attach said boom structure to such tap hole nozzle in an axially aligned position.

14. A drilling apparatus, according to claim 12, in which said means to securely position said base structure relative to such steelmaking vessel comprises at least one pin member insertable into an aperture adapted to receive and engage said pin member.

15. A drilling apparatus, according to claim 12, in which said base structure includes means to permit said boom structure to be pivoted laterally sufficient to permit exchange at the end of said drill shaft between said drill bit and said spindle away from the vicinity of such tap hole nozzle.

16. A drilling apparatus, according to claim 12, in which said first motor means comprises a percussion drill capable of imparting both a rotary and an impact force on said drill shaft.

17. A drilling apparatus, according to claim 12, in which said elongated drill shaft has an axial aperture extending the length thereof, and said drilling apparatus included means for blowing air through said aperture.

18. A drill bit for a drilling apparatus for drilling a worn or damaged tap hole refractory liner sleeve from a tap hole nozzle of an oxygen blown steelmaking vessel, said drill bit comprising:

(a) a circular base plate having an axis, a forward side and a back side;

(b) means for attaching said back side of said base plate to a drill shaft of such drilling apparatus such that said axis of said base plate is aligned with an axis of such drill shaft;

(c) a plurality of substantially identical, conventional rock drill bits, each having an axis and secured to said forward side of said base plate such that said axes of said plurality of rock drill bits are generally parallel to said axis of said base plate;

(d) a first portion of said plurality of drill bits equally spaced in a first circular arrangement circumscribing said axis of said base plate; and (e) a second portion of said plurality of drill bits, equally spaced in a second circular arrangement circumscribing said first circular arrangement.

19. A drill bit, according to claim 18, in which said second circular arrangement of drill bits are disposed in a plane axially forward of said first circular arrangement.

20. A drill bit, according to claim 19, in which the number of drill bits in said first portion is equal to one less than the number of drill bits in said second portion.

* * * * *